US005147074A

United States Patent [19]

Battegazzore

[11] Patent Number: 5,147,074

[45] Date of Patent: Sep. 15, 1992

[54] DEVICE FOR RELEASABLY CONNECTING A SPRAYER HAVING A PUMP OPERATED THROUGH A TRIGGER-TYPE LEVER TO THE NECK PORTION OF A HAND-HELD CONTAINER

[75] Inventor: Piero Battegazzore, Alessandria, Italy

[73] Assignee: Guala S.p.A., Alessandria, Italy

[21] Appl. No.: 669,901

[22] Filed: Mar. 15, 1991

[30] Foreign Application Priority Data

Mar. 27, 1990 [IT] Italy ..... 19827 A/90

[51] Int. Cl.[5] ..... B67D 5/40

[52] U.S. Cl. ..... 222/383; 215/318; 239/333

[58] Field of Search ..... 239/333; 215/216, 318, 215/319; 222/204, 321, 383, 385, 341

[56] References Cited

U.S. PATENT DOCUMENTS

| | | | |
|---|---|---|---|
| 3,094,250 | 6/1963 | Molyneaux et al. | 222/207 |
| 3,770,206 | 11/1973 | Tada | 222/385 X |
| 3,780,951 | 12/1973 | Powers | 239/333 |
| 4,340,158 | 7/1982 | Ford et al. | 222/321 |
| 4,345,691 | 8/1982 | Burke | 215/216 |
| 4,375,266 | 3/1983 | Magers | 222/321 |
| 4,434,917 | 3/1984 | Salto et al. | 222/383 |
| 4,949,075 | 8/1990 | Lundbäck | 222/207 X |
| 4,955,511 | 9/1990 | Blake | 222/383 X |

*Primary Examiner*—Andres Kashnikow
*Assistant Examiner*—Kenneth Bomberg
*Attorney, Agent, or Firm*—Notaro & Michalos

[57] ABSTRACT

A device for releasably connecting a generic liquid sprayer, e.g. for detergents and the like, of the type including a pump operated through a trigger-type lever, to the neck portion of a container of the hand-held type. The device has a tubular element provided with a threadway on its inner surface which is releasably engaged, as by threading down, by a sleeve whose inner surface is provided with snap-action members of engagement with counter-members provided on the container neck portion to provide a non-releasable axial coupling. The sleeve enables initial assembly of the device by axial fitting over the container neck portion and recovery of the device by threading out of the sleeve, for later re-use on a re-fill container provided, in turn, with a sleeve, once the original conatiner has been depleted of its contents. In addition, the device enables the delivery nozzle and trigger-type lever of the sprayer to be properly positioned relatively to the container contour, particularly where the latter has an anatomical type of configuration.

7 Claims, 2 Drawing Sheets

DEVICE FOR RELEASABLY CONNECTING A SPRAYER HAVING A PUMP OPERATED THROUGH A TRIGGER-TYPE LEVER TO THE NECK PORTION OF A HAND-HELD CONTAINER

FIELD AND BACKGROUND OF THE INVENTION

This invention relates to a device for releasably connecting a generic liquid sprayer of the type operated through a trigger-type lever to the neck portion of a hand-held container, which comprises a base body carrying the pump and members for actuating it, and a tubular element formed with a threadway on its inner surface, being associated with said base body and open at its end adjacent to the container neck portion for connection to the latter.

Sprayer devices of this type have been known in the related art, and one example is illustrated in U.S. Pat. No. 4,361,256.

According to that prior art, sprayer devices of the type mentioned above are secured on the neck portion of the container by threadably engaging the threaded tubular element therewith which fits rotatably on the pump-carrying base body for this purpose.

Thus, for attaching the device to the container, it becomes necessary to either provide a manual procedure or automated equipment incorporating arrangements for driving said tubular element rotationally so as to have it threaded down tightly, such arrangements having the disadvantage of being relatively complicated, and therefore expensive.

In addition, prior devices of the type illustrated in the above-mentioned U.S. patent, for example, have another disadvantage in that, each time that they must be transferred to a re-fill container after removal from a depleted container, they allow of no quick and straightforward alignment of the delivery nozzle and trigger-type lever to the container body where the latter is fashioned with an anatomical contour and intended for holding in a set position with one hand whereto the positions of the trigger-type lever and spray nozzle should also be related.

Since to provide a sealed connection between the sprayer device and the container the collar requires to be threaded down tightly, it frequently happens, in fact, that the device setting in this tightened state fails to correspond to that required for a proper grip on the container.

SUMMARY OF THE INVENTION

Accordingly, it is the object of this invention to obviate the drawbacks of convention sprayers by providing a device for connection to the container which can be fitted initially through automatizable, cost-efficient operations, and later transferred to re-fill containers, even anatomically contoured ones, without losing its designed operational setting and ability to provide a hydraulically tight closure.

This object is achieved by a device as indicated for releasably connecting sprayers to their containers, being characterized as in the appended claims.

BRIEF DESCRIPTION OF THE DRAWINGS

The invention will be now described in greater detail with reference to a practical embodiment thereof illustrated, by way of non-limitative example in the accompanying drawings, where.

DESCRIPTION OF THE PREFERRED EMBODIMENT

Figure 1:
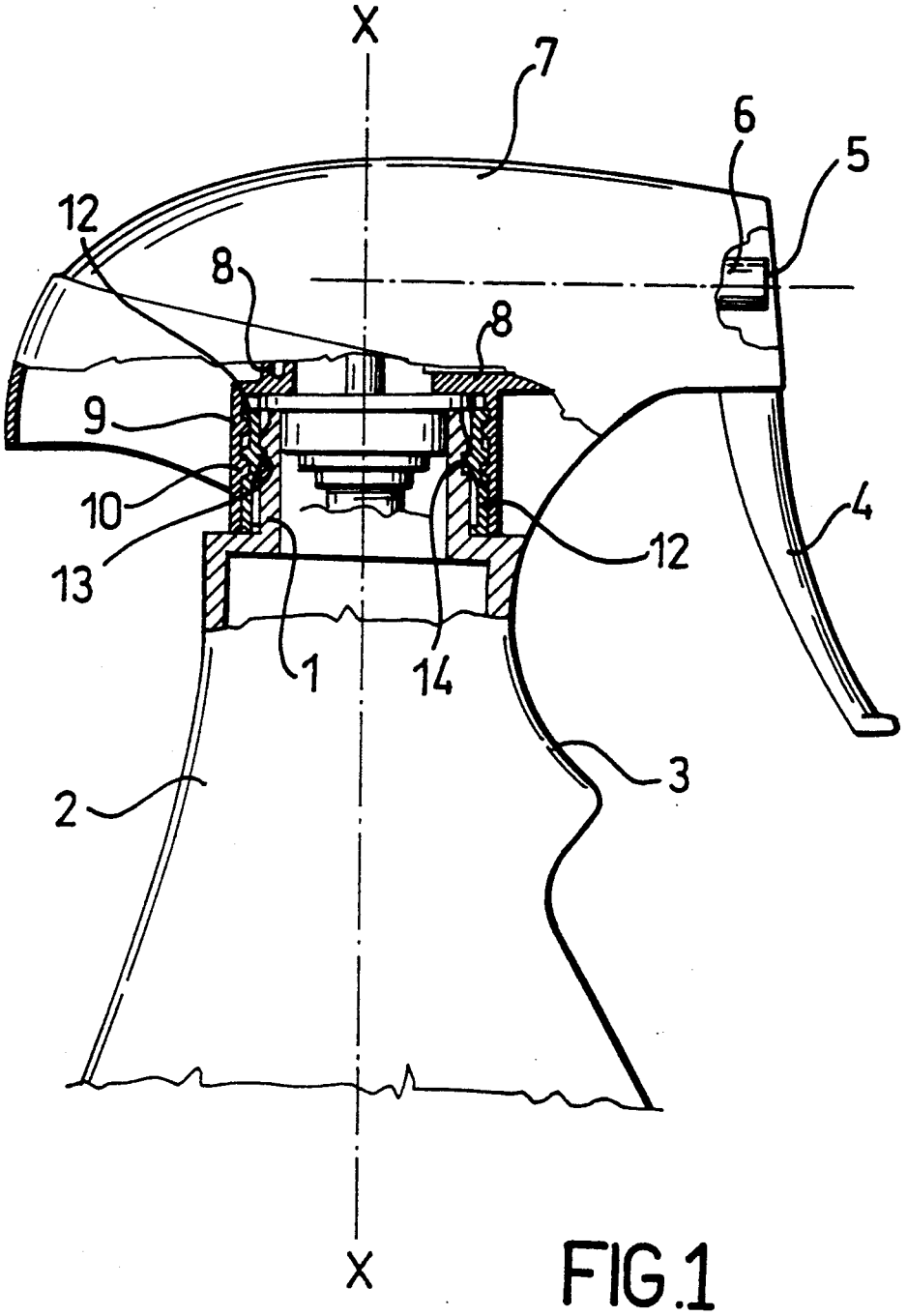
FIG. 1 is a cross-sectional view of a device according to the invention.
Figure 2:
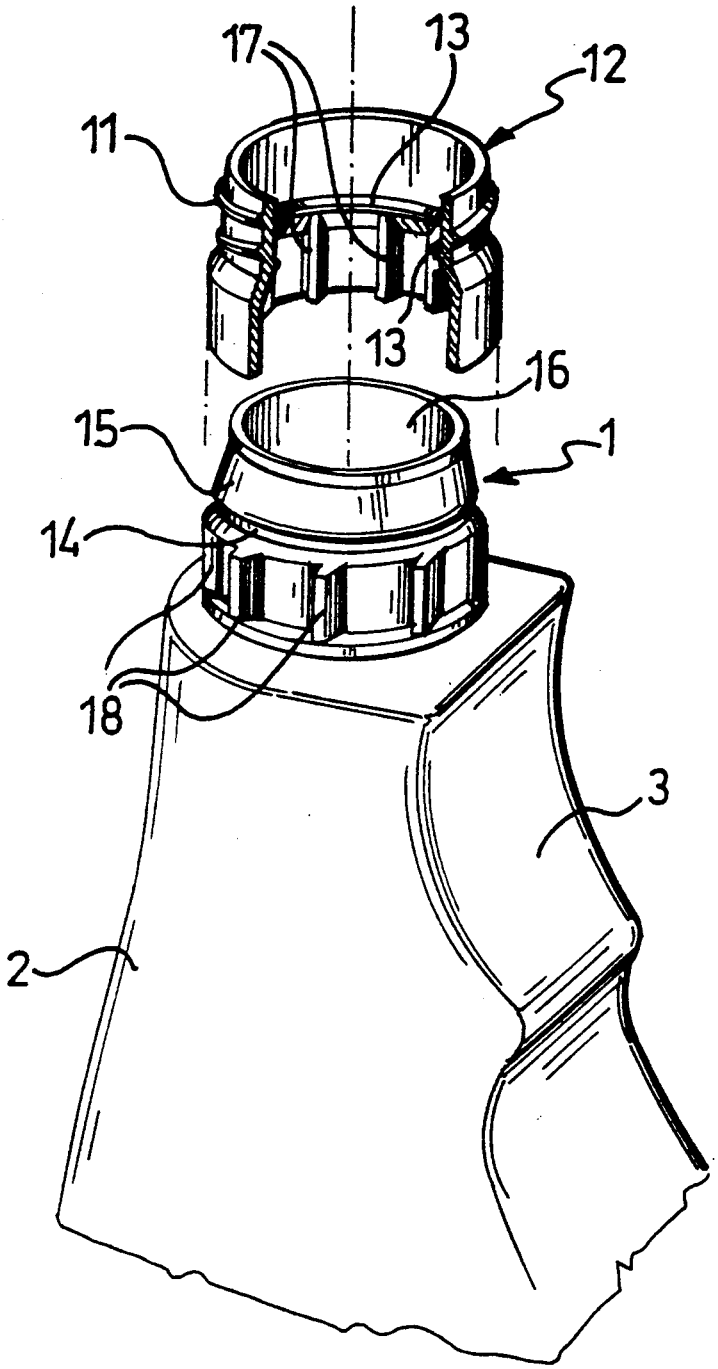
FIG. 2 is an exploded perspective view of the neck portion of a re-fill container for use with the inventive device.

With reference to the drawing figures, indicated at 1 is the neck portion of a container 2 adapted to be filled with a liquid, such as detergent, disinfectant and the like solutions, for delivery in spray form.

The container is, in particular, anatomically contoured as indicated by the outline 3, for a more comfortable grip and operation of the trigger-type lever 4.

The spray of liquid is delivered by means of a pump, not shown because conventional, and through a nozzle 5 provided at the end of a conduit 6 which lies on the same plane where the angular movement path of the trigger-type lever 4 lies and perpendicularly to the axis X—X of the container 2.

A removable cap 7, which is tailored to the container 2, encloses the pump and trigger-type lever mechanisms carried on the base body 8.

According to the invention, the latter is provided with a tubular element 9 made unitary therewith.

The inner surface of the element 9 is formed with a threadway 10 which engages with a mating threadway 11 formed on the outer surface of a sleeve 12.

This sleeve is accommodated inside the tubular element 9 and engages the outer surface of the neck portion 1 of the container 2 through snap-action means which, while providing for an axial fit, prevent subsequent removal.

Such means comprise an annular ridge 13 having a preferably trapezoidal cross-sectional shape and being formed on the inner surface of the sleeve 12, and a groove 14 of mating shape formed in the outer surface of the neck 1.

These means are completed by a frusto-conical flare 15 extending between said groove 14 and the orifice 16 of the container, with the small diameter next to said orifice.

Also according to the invention, the inner surface of the sleeve 12 is provided with a plurality of radially extending ribs 17 which will interfere, at their ends, with corresponding counter-ribs 18 formed on the outer surface of the neck 1.

The ribs 17 and counter-ribs 18 lie at an angle to the surface from which they stand proud in opposite circumferential directions, thereby they extend substantially parallel to one another.

It follows that the sleeve 12 can be shifted angularly along the direction permitted by the rib inclination, but not in the opposite direction except, at most, through the gap between contiguous ribs.

The screwing direction afforded by the threadways 10 and 11 corresponds to the direction in which the sleeve 12 can be moved relatively to the neck 1.

It may be appreciated from the foregoing that, on the occasion of the original installation of the sprayer on the container at the filling station, with the sleeve 12 inserted into the tubular element 9, a mere approaching movement to the container axis X—X is all that is required, which movement can be readily and economically implemented on automatically operated equipment, with considerable economical benefits for the user and the end consumer alike.

On the occasion of a possible re-use of the sprayer on a re-fill container, by having the latter provided with a sleeve 12 over its neck portion, the user will be able to screw the tubular element 9 onto the sleeve, after removing a small protective closure cap not shown, of the re-fill container and tighten it down to prevent leakouts of liquid without having to concern himself with whether the trigger-like lever 4 and orifice 5 are correctly set with respect to the anatomical contour 3 of the container.

Should this setting fail to coincide with the fully tightened setting, the proper setting can be still achieved by a further angular movement of the element 8 in the tightening direction, to entrain the sleeve 12 and overcome the frictional resistance between inclined ribs 17 and 18.

Threading out the tubular element 9, to further recover the sprayer and re-use it, is instead allowed by the antagonism provided in the opposite direction by these same ribs 17 and 18 on the sleeve 12.

The dimensions and materials may be any ones contingent on individual demands without departing from the true scope of the invention as described hereinabove and claimed hereinafter.

What I claim is:

1. A device for releasably connecting a sprayer operated through a trigger-lever, to a neck portion of a hand-held container, the neck portion having an orifice, the device comprising: a base body carrying the sprayer; a tubular element formed with an inside threadway on an inner surface, and open at an end adjacent to the container neck portion for connection to a sleeve, said tubular element being attached rigidly to the base body; and the sleeve located inside said tubular element, an outer surface of said sleeve being threadably and releasably engaged with said inside threadway of the tubular element, said sleeve having an inner surface provided with a snap-action engagement means engaging with a counter-means provided on the container neck portion forming an unreleasable axial coupling.

2. A device according to claim 1, wherein said sleeve includes, formed on its inner surface, a plurality of radial ribs interfering with radial counter-ribs formed on the outer surface of the container neck portion, said ribs and counter-ribs being inclined relatively to the surface from which they stand proud in opposite circumferential directions such that they are substantially parallel to one another and allow an angular movement of the sleeve in one direction relatively to the neck portion and prevent it in the opposite direction.

3. A device according to claim 1, wherein said snap-action engagement means provided on the inner surface of said sleeve comprise an annular ridge having a substantially trapezoidal cross-sectional shape.

4. A device according to claim 1, wherein said counter-means provided on the container neck portion and producing, with said snap-action engagement means on the sleeve, an unreleasable axial coupling, comprise a ridge in said sleeve and an annular groove whose cross-sectional shape mates with that of the ridge in the sleeve, and a frusto-conical flare extending from the orifice of the neck portion to said groove, a small diameter of said frusto-conical flare being located close to the orifice.

5. A sprayer incorporating the device for releasable connection to the container according to claim 1.

6. A re-fill container for sprayers, comprising a neck portion and a sleeve coaxially mounted on and around said neck portion, a threadway on an outer surface of said sleeve, snap-action means on an inner surface of said sleeve for engagement with counter-means provided on the container neck portion into an unreleasable axial coupling, a plurality of radial ribs formed on the inner surface of said sleeve, a plurality of radial counter-ribs formed on an outer surface of said neck portion, said ribs and counter-ribs interfering with each other and being inclined relatively to the surface from which they stand proud in opposite circumferential direction, whereby they are substantially parallel to one another, allow an angular movement of the sleeve in one direction relatively to the neck portion and prevent it in the opposite direction.

7. A re-fill container for sprayers according to claim 6, wherein said snap-action means provided on the inner surface of said sleeve comprise an annular ridge having a substantially trapezoidal cross-sectional shape and said counter-means, provided on the container neck portion, comprise an annular groove whose cross-sectional shape mates with that of the ridge on said sleeve and a frusto-conical flare extending from an orifice of said neck portion to said groove, the small diameter of said frusto-conical flare being located close to the orifice.

* * * * *